US006137855A

United States Patent [19]

Hill et al.

[11] Patent Number: 6,137,855

[45] Date of Patent: Oct. 24, 2000

[54] CORRUGATED SHEET COUNTER

[76] Inventors: Gregory D. Hill, 7613 Gordon Way, Indianapolis, Ind. 46237; Edward Sternberg, 880 Hoffman Ter., Los Altos, Calif. 94024

[21] Appl. No.: 09/410,733

[22] Filed: Oct. 1, 1999

Related U.S. Application Data

[63] Continuation of application No. 08/962,507, Oct. 31, 1997.

[51] Int. Cl.[7] ..... G06M 11/00

[52] U.S. Cl. ..... 377/8

[58] Field of Search ..... 377/8

[56] References Cited

U.S. PATENT DOCUMENTS

| | | | |
|---|---|---|---|
| 3,835,306 | 9/1974 | Bills et al. | 235/92 SB |
| 4,296,314 | 10/1981 | Dabisch et al. | 235/92.022 |
| 4,331,879 | 5/1982 | Gersl | 250/561 |
| 4,417,351 | 11/1983 | Williamson et al. | 377/8 |
| 4,481,667 | 11/1984 | Price et al. | 382/65 |
| 5,040,196 | 8/1991 | Woodward | 377/8 |
| 5,457,312 | 10/1995 | Mansour | 250/222.2 |
| 5,495,104 | 2/1996 | Craddock | 250/222.1 |
| 5,534,690 | 7/1996 | Goldenberg et al. | 250/222.1 |
| 5,686,729 | 11/1997 | Bittar et al. | 377/8 |
| 5,696,802 | 12/1997 | Hafezan | 377/8 |

*Primary Examiner*—Margaret R. Wambach
*Attorney, Agent, or Firm*—Bose McKinney & Evans LLP

[57] ABSTRACT

A device for counting the number of corrugated articles in a stack of corrugated articles includes a light source for illuminating a multi-article containing surface of the stack of corrugated articles. An electro-optical image capturing camera captures a first visual image frame of a first segment of the multi-article containing surface, and a signal converting means converts the first visual image frame into a first electronic frame signal representative of the first visual image frame. A central processing unit, a frame grabber circuit and software process the first electronic frame signal into a first series of article signals representative of the series of individual articles of the first segment of the multi-article containing surface. The processor also counts the number of individual articles in the first series of article signals. The camera is mounted on a belt track assembly, and movable by a stepper motor from a first position to a second position for permitting the camera to capture a second visual image frame of a second segment of the multi-article containing surface.

9 Claims, 9 Drawing Sheets

CORRUGATED SHEET COUNTER

This is a continuation of application Ser. No. 08/962,507 now allowed filed Oct. 31, 1997.

TECHNICAL FIELD OF THE INVENTION

The present invention relates to production equipment for use in manufacturing flat, stackable articles, and more particularly to a counting device for counting the number of flat articles, such as corrugated sheets, in the stack.

BACKGROUND OF THE INVENTION

Corrugated paperboard has gained wide-spread acceptance in the packaging industry because of its strength, its cost advantages, and its ability to protect the contents of the package. One of the best known types of corrugated packaging is a corrugated box.

A corrugated box is formed from a sheet of corrugated material that is cut, folded, and stapled or glued (where necessary) to create the desired finished shape of the box. The manufacture of a corrugated box often occurs in several steps performed by different people. A first company will often manufacture the corrugated sheets. The corrugated sheets are then placed in stacks and shipped to a printer, who prints the flat sheets. The printed corrugated sheets can then be tendered to a converter who folds, cuts, and staples the sheet to convert the flat sheet into a three dimensional package, such as a corrugated box.

As shown in FIG. 1, a single wall corrugated sheet 10 includes a top liner 12, a bottom liner 14, and a medium 16 that is also referred to as a "flute". The flute 16 extends between the top liner 12 and the bottom liner 14. The liners 12, 14, and flute 16, are usually made from a heavy paper known in the industry as "kraft" paper. High speed corrugating machinery (not shown) heats, moisturizes and glues three layers of kraft paper together so that the top and bottom liners 12, 14 are planar and the medium ("flute") layer 16 is curved in a sinusoidal pattern. High speed, automated equipment is also used to cut the sheets to their desired size, and then stack the sheets onto a pallet for shipment.

The corrugated paperboard industry manufactures corrugated sheets 10 in a wide variety of "thickness" sizes. However, the industry has also adopted several "standard thicknesses" used by packagers to identify the particular characteristics of the sheet that they desire. To some extent, the differences in thicknesses result from the thicknesses of the liners 12, 14 that are used, although, to a larger extent, thickness differences result from the height, and manner in which the medium layer 16 is fluted. The thickness "A" of a particular corrugated sheet 10 is referred to as its "caliper". By convention, the caliper A is measured to include the thickness of the entire corrugated sheet 10, including the top liner 12 and bottom liner 14.

Currently, several standards exist that have gained widespread acceptance in the industry. These various standards are known as "A-flute", "B-flute", "C-flute", "E flute", and "F flute". Of these, A flute is generally the thickest, and F flute (also known as micro-flute) is the thinnest.

Due to the mechanical tolerances of the corrugating machines themselves, variations in caliper occur in each flute type. Generally, these variations are tolerated by the industry, as they are usually only on the order of a few thousandths of an inch. Variations in sheet caliper also occur due to the uneven moisturizing and heating of the kraft paper, the uneven amounts of glue used to bond the separate layers together, and the uneven basis weight of the kraft paper.

In FIG. 2, a double-wall corrugated sheet 20 is shown that consists of five layers of kraft paper, including a generally planar top liner 22, a generally planar middle liner 24, and a generally planar bottom liner 26. A first fluted layer 28 extends between the top liner 22 and the middle liner 24, and a second fluted layer 30 extends between the middle liner 24 and the bottom liner 26. The overall caliper of the double wall corrugated sheet is comprised of the addition of the caliper B of the upper layer of the double walled corrugated sheet, and the caliper C of the bottom layer of the double walled corrugated sheet.

The choice of particular calipers to be joined together (e.g. A flute and C flute) depends upon the desires of the manufacturer and purchaser. Generally any combination of flute size (e.g. A flute and C flute; B flute and C flute; C flute and E flute, etc.) can be used to create double walled corrugated sheets. Double walled corrugated sheets 20 are similar to single corrugated sheets 10, insofar as variations exist within the standard caliper for each type of flute combination. For example, an A/B flute caliper from one batch may have a greater or lesser thickness (caliper) than an A/B flute sheet from another batch, due to differences in paper, glue, etc.

Just as the individual sheets, e.g. 10, 20, are not consistent from batch to batch, the stacks in which the sheets are placed often contain substantial inconsistencies, and do not represent perfect arrays of corrugated sheets. Turning now to FIG. 3, a stack 40 of corrugated sheets is shown being placed on top of a pallet 42. The stack 40 includes sheets 44, 46, 48, 50, 52, 54, and 58. Sheets 44, 46, 50, 54 and 58 are all positioned similarly, so that their edges are aligned at the "nominal edge" of the stack of 40. However, the edge of sheet 48 is recessed inwardly from the nominal edge, and the edge of sheet 52 protrudes outwardly from the edge. Additionally, a gap 60 exists between sheets 58 and 54 that is devoid of material. Such gaps 60 are quite common, and are caused by the fact that the sheets are often not perfectly planar. This non planarness is referred to as "warpage."

After the stack of sheets is discharged from the stacking machinery, human operators visually inspect the stack for certain errors in the desired quality of the sheets, and manually remove from the stack, any sheets that do not meet quality standards. Also, an operator may choose to restack one or more stacks manually on the roller/conveyor. Thus, it is unlikely that several stacks, which have been consecutively discharged by the stacking machinery, will consist of exactly the same number of individual sheets. As such, there could be a substantial variation in the number of sheets within any particular stack.

To achieve proper inventory control at the production facility and appropriate customer invoicing, it is desirable to determine the exact count of individual sheets in each particular stack of sheets which are produced by the sheet manufacturer.

Several methods of counting sheets are known. In particular, three general methods exist. The first method involves the use of a human operator who measures the height of the stack of corrugated sheets with a tape measure, and then derives the number of sheets contained in the stack by dividing the height of the stack by the thickness of a particular sheet. A second method for counting sheets involves linear displacement, and a third involves the use of optical devices having a limited focal range.

The first method involving the human operator who measures the height of a stack with a tape measure has some inherent problems that may induce error. This method is prone to human error such as misreading the tape measure, calculator key punching errors and errors made in copying the total sheet count onto a paper shipping ticket. Additionally, variations in actual sheet thickness also induces errors. Although the variations in the thickness of particular sheets from batch to batch is usually small, and within acceptable tolerances, the aggregate variation that would exist in a stack containing a large number of sheets may be sufficiently great so as to cause a stack of particular size (e.g. 72 inches) to contain substantially more or less sheets than another stack of the same size, even if the individual sheet variance between the two stacks thickness is small. Another error in the human method is caused by the non-planarness (warpage) of the sheets in a stack. This warpage can cause gaps between adjacent sheets. If a sufficient number of gaps exist in a stack, then the sheet count can be miscalculated significantly.

The second method relates to the use of linear displacement to count the number of corrugated sheets in a stack. A stack counting apparatus using such a linear displacement technique is disclosed in Williamson et al U.S. Pat. No. 4,417,351. Williamson discloses the use of a movable platen that senses the total height of a stack by applying pressure to the top of the stack to compress the gaps that are created by the non-planarness (warpage) of the sheets. With a separate sensor, the device determines the thickness of a single sheet, and then calculates the total number of sheets by dividing the height of the stack by the thickness of a single sheet. While the induced compression makes this method less error prone than the first method, minor variations in the thickness of the corrugated board produced at the corrugating machinery can, when multiplied by many sheets in the stack, result in an erroneous total calculated sheet count. Additionally, this method requires a human operator to insert a single sheet into the thickness sensor manually for each stack to be counted, resulting in time delays and extra labor costs for the production facility.

The third known prior art method involves the use of an optical device having a limited focal range, such as the device disclosed in Woodward U.S. Pat. No. 5,040,196. Woodward discloses an optical device that is held in physical contact with the side of a stack of sheets, and then moved perpendicularly, by a human operator, from the bottom of the stack to the top. Woodward's device must be calibrated for the particular board thickness (flute) before using it to count the sheets in the stack. Therefore, it is possible that an operator must recalibrate the device between successive counting operations on stacks of different flute types. This calibration can be time consuming and costly. Another difficulty is that the Woodward device must be held in physical contact with the side of the stack. As such, it is believed that the Woodward device may have difficulty counting sheets within a stack that are not at the nominal edge of the stack, such as protruding sheet 52 (FIG. 3) and recessed sheet 48. Protruding sheets would be especially problematic, as they would tend to act as a barrier against the vertical movement of the device.

Another drawback with the Woodward device is that since it is hand-held, it requires a human operator to position the device in physical contact with the stack and move the device at a uniform speed from the bottom to the top of the stack.

Additional prior art devices for counting sheets are shown in Gersl U.S. Pat. No. 4,331,879 and Adabisch U.S. Pat. No. 4,296,314.

Although the foregoing devices may perform their intended functions in a workman-like manner, room for improvement exists. In particular, room for improvement exists in providing a more highly automated device that is capable of accurately counting corrugated sheets, in a stack of sheets that are stacked in a less than perfect manner. It is therefore one object of the present invention to provide such a device.

SUMMARY OF THE INVENTION

In accordance with the present invention, a device is provided for counting the number of corrugated articles in a stack of corrugated articles. The device comprises a light source for illuminating a multi-article containing surface of the stack of corrugated articles. An electrooptical image capturing means is provided for capturing a first visual image frame of a first segment of the multi-article containing surface. A signal converting means is provided for converting the first visual image frame into a first electronic frame signal representative of the first visual image frame. Processing means are provided for processing the first electronic frame signal into a first series of article signals representative of the series of individual articles of the first segment of the multi-article containing surface. The processing means also counts the number of individual articles in the first series of article signals.

Preferably, the device also includes a mounting means for mounting the image capturing means, and a moving means for moving the image capturing means from a first position to a second position for permitting the image capturing means to capture a second visual image frame of a second segment of the multi-article containing surface. The processing means can also include a comparing means for comparing the first electronic frame signal taken from the first visual image, to the second electronic frame signal captured from the second visual image to ensure that any of the articles appearing in both of the first and second electronic frames are counted only once.

One feature of the present invention is that no part of the device comes into physical contact with the stack of sheets. This feature has the advantage of enabling the device to count sheets that are recessed or protruding from the nominal edge of the stack. Because of the way it operates, such protruding or receding sheets will not affect the operation of the device.

A further feature of the present invention is that the device is designed to analyze only a portion of the image from each individual sheet. This portion is referred to in this application as the "region of interest". By analyzing only a portion of the sheet, the amount of data that must be analyzed and processed is reduced.

It is also a feature of the present invention that a discriminator means is provided for discriminating between components of a sheet and empty spaces that are devoid of materials. This feature has the advantage of enabling the device to obtain an accurate count of sheets within a stack; a count that is unaffected by gaps between adjacent sheets caused by the non-planarness (warpage) of any particular sheet.

Another feature of the present invention is that the device includes means for determining whether the sheets in a particular stack comprise single wall sheets (such as shown in FIG. 1) or double wall sheets (such as shown in FIG. 2). This feature has the advantage of enhancing the accuracy of the count (and the flexibility of the device), as it makes the count unaffected by whether the sheets are single wall or double wall.

A further feature of the present invention is that the software is configured so that a human operator can begin the counting process by pressing only one key of the keyboard of the central processing unit. The software is designed to automatically perform the functions necessary to count the sheets, including taking the appropriate images, moving the camera as appropriate, and analyzing the images, without the need for human intervention. By automating the process, labor costs are reduced, and the overall material flow through the production facility is increased.

An additional feature of the present invention is that it measures the number of sheets within a stack by taking a video image of the particular sheets. This method avoids the use of mathematical extrapolations of the type that must be made when a sheet count is made by determining the height of the stack and dividing the height by the thickness of a particular sheet.

Another feature of the present invention is that the software used with the present invention permits camera movement to be automated. Additionally, camera movement can be calibrated so that a particular camera movement pattern works well for sheets of all sizes, without any need for any recalibration for stacks of various flute types. This feature has the advantage of enabling an accurate count to be taken independent of the flute type, thus reducing the need for constant calibration.

Also in accordance with the present invention, a method is provided for counting the number of corrugated articles in a stack of corrugated articles. The method includes the step of providing an electronic image capturing means capable of capturing visual image frames of at least a first segment of a multi-article containing surface. A signal converting means capable of converting the visual image frames into electronic image frames is also provided, along with a processing means capable of processing electronic image frames. Further provided is a moving means for moving the electro-optical image capturing means. The image capturing means is positioned to capture a visual image of a first segment of a multi-article containing surface. The processing means is provided with information about the size and shape characteristics of the corrugated article. A first visual image frame of the first segment is captured, and the first visual image frame is converted into a first electronic image frame. A region of interest is selected from within the first electronic image frame, from which signal data will be analyzed. The intensity of the signal data within the region of interest is analyzed to differentiate (discriminate) between signals indicative of elements of the articles to be counted, and empty space. The number of corrugated articles are then determined by using the analyzed data.

These and other features and advantages of the device will become apparent to those skilled in the art upon review of the detailed description of the best mode of practicing the invention perceived presently by the applicants, as set forth below in the drawings and detailed description.

DETAILED DESCRIPTION OF PREFERRED EMBODIMENT

A. The Components of the Device.

Figure 1:
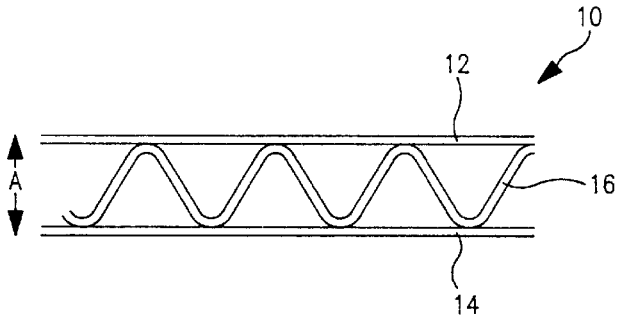
FIG. 1 PRIOR ART
FIG. 1, is a schematic, end view of a single wall, prior art corrugated sheet.
Figure 2:
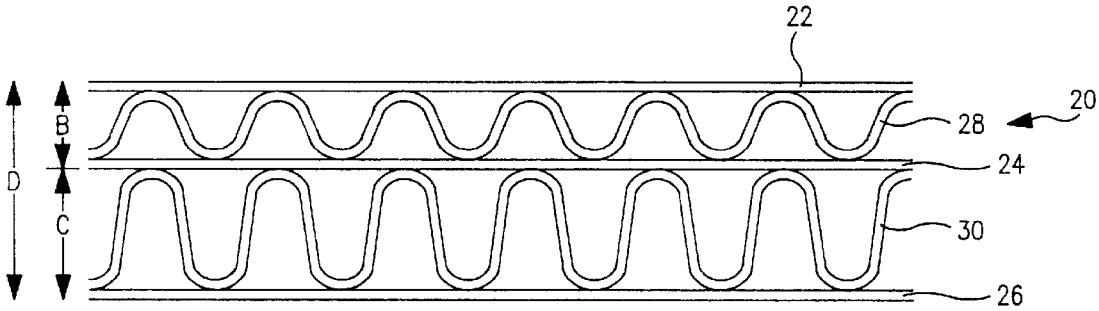
FIG. 2 PRIOR ART
FIG. 2 is a schematic, end view of a double wall corrugated sheet (also in the prior art)
Figure 3:
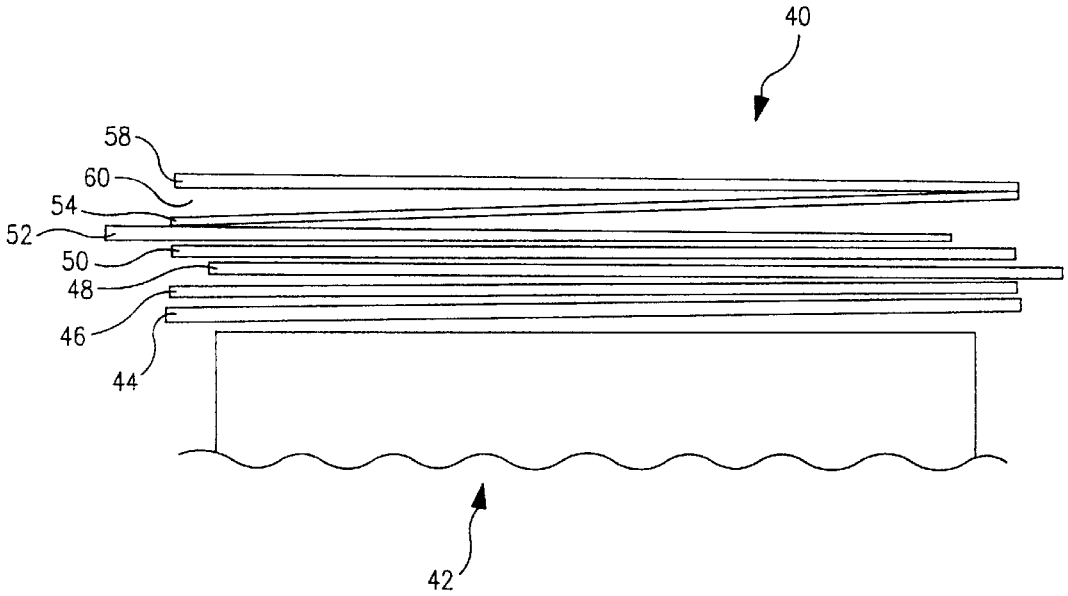
FIG. 3 PRIOR ART
FIG. 3 is a schematic, side elevational view of a stack of corrugated sheets mounted on a pallet (all of which is in the prior art)
Figure 4:
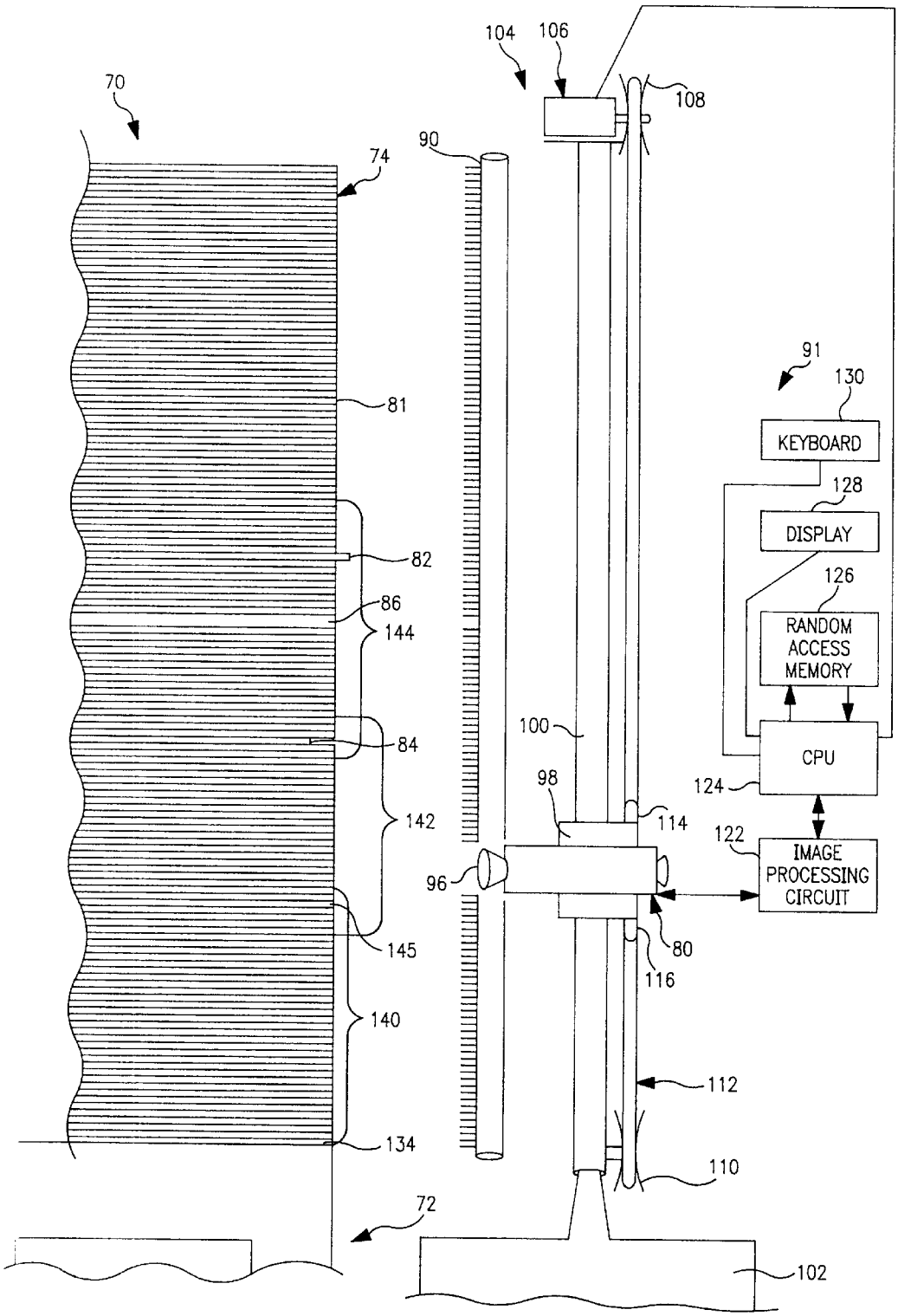
FIG. 4 is a schematic, side elevational view of the apparatus of the present invention.

A somewhat schematic drawing of the apparatus 91 of the present invention is best shown in FIG. 4, wherein the device 91 is shown as being placed adjacent to a stack 70 containing a multitude of corrugated articles such as single and double wall corrugated sheets. Corrugated articles 70 are stacked upon a pallet 72 which supports the corrugated articles 70 above the ground, so that the stack 70 can be moved by a forklift engaging the pallet. The stack 70 includes a surface 74 which exposes the ends of the flutes of the multi-article containing stack 70 to an electro-optical image capturing device such as electronic camera 80. Surface 74 exposes the ends of the flutes, similar to the view shown in FIG. 5.

Figure 5:
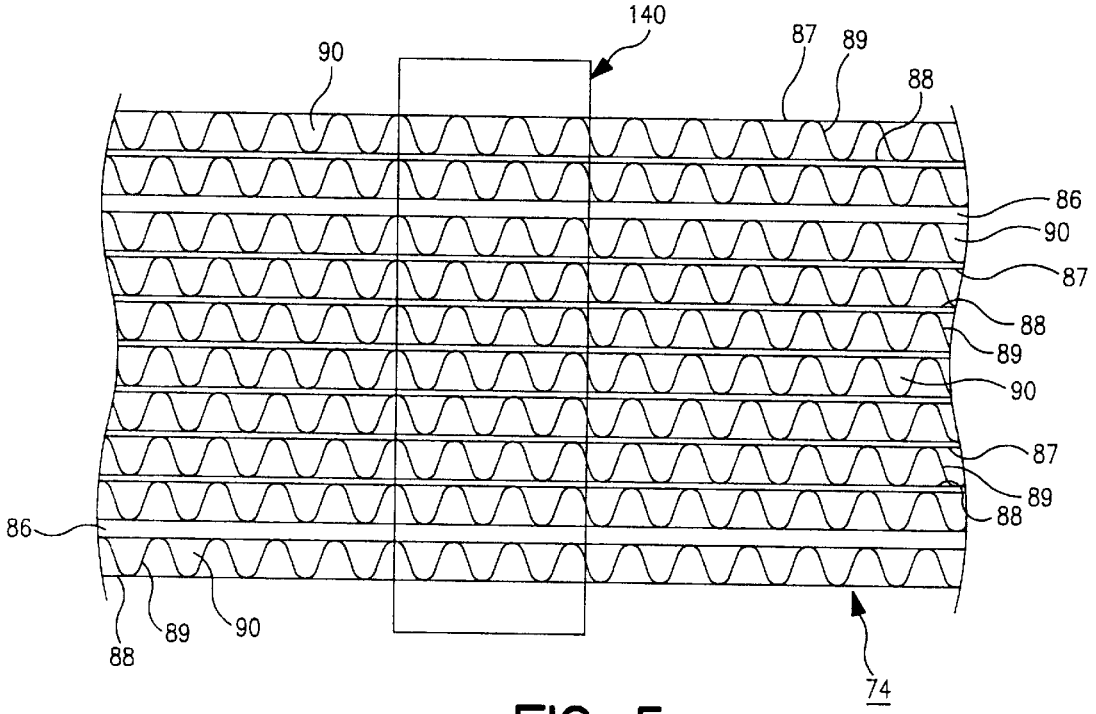
FIG. 5 is a schematic, end view of a stack of corrugated articles, showing the region of interest.

The surface 74 that faces the camera 80 is generally planar as the majority of the sheets, such as sheet 81 have their edges aligned, so that the combination of the edges of the various sheets forms a generally planar, vertically extending surface. However, surface 74 is not perfectly planar, as it includes protruding sheets, such as sheet 82, that extend outwardly from the surface 74, and recessed sheets such as recessed sheet 84, whose edges are recessed inwardly from the edge of the surface 74. Additionally, surface 74 does not comprise a solid surface. As best shown in FIG. 5, the view that the camera 80 has of surface 74 is one of a plurality of top liners 87, bottom liners 88, and medium layers (flutes) 89. Additionally, spaces 90 that exist between the material of the flute 89. These spaces 90 exist because the view of surface 74 from the camera 80 is one wherein the flutes 89 extending longitudinally, in a direction perpendicular to the plane of the surface 74. Additionally, FIGS. 4 and 5 show that gaps 86 exist between adjacent sheets. These gaps are caused because of the warpage that occurs to the surfaces of the corrugated sheets.

The device 91 is shown in FIG. 4 as including a light source 90 that is mounted in the fixture (not shown). The light source 90 should be designed to provide a uniform source of parallel light rays over the surface 74, or at least over that portion of surface 74 that comprises that portion of the surface that camera 80 will take a picture of. The applicants have found that a two lamp fluorescent fixture that uses standard 4 foot long, 40 watt lamps serves well for this purpose. The camera 80 preferably contains a zoom lens 96 that can zoom in or out depending upon the particular flute size of the stack 70. Preferably, the camera 80 is a digital zoom, video array camera producing a standard NTSC video electrical signal, such as a SONY Model EVI-330T type camera.

A mounting means 98 which preferably comprises a slidable car, mounts the camera 80 onto a vertically extending track 100. The mounting means 98 is slideable in a vertical direction along the track 100, so that the camera can move vertically along the track 100 from the bottom to the top of the stack of sheets. A base 102, is coupled to the lower end of the track 100, and supports the track 100 above the ground.

A moving means 104 is provided for automatically moving the camera 80 up and down the track 100. The moving means 104 includes a stepper motor 106 that is controllable by a Central Processing Unit (CPU) 124 to move the camera 80 in discreet intervals (steps) up and down the track 100. Stepper Motor assembly 106 preferably comprises an Animatics Motor, SM2310, Animatics gear head, Model No. 23SI010, an Animatics motor cable assembly, Model No. CBLSM1; and an Animatics, Model No. PS24V8A, 24 volt power supply.

The moving means 104 also includes an upper pulley 108 that is mounted to the stepper motor 106, and a lower pulley 110 that is mounted adjacent the lower end of track 100. A belt 112 extends around the pulleys 108, 110 and is coupled to the mounting means 90 for moving the mounting means along the track 100, and hence the camera 80 up and down the track 100. Preferably, the belt assembly 112, comprises an Item Products Inc. belt assembly, Model No. 761289-1 linear assembly.

The stepper motor 106 is capable of operation in two directions, so that it can move the camera 80 both up and down the track 100 without the need for the intervention of reversing gears or the like. In this regard, the stepper motor 106, track 100, belts 112, and camera 80 are designed to perform in a manner similar to a manner in which an inkjet printer operates, with respect to the movement of its printer head.

The longitudinal axis of the camera 80 is preferably mounted perpendicular to the nominal edge of the stack of sheets so that the camera lens 96 focuses upon the stack as it captures an image of the surface edge 74 of the stacks 70. The reflective parallel light that shines from the light source 90 forms an image of the fluted edge 74 of the sheets on a two-dimensional photo cell array within the camera 80. The camera 80 is coupled to an electronic video processing circuit 122, that preferably comprises a "frame grabber" type of electronic video processing circuit. The purpose of the electronic video processing circuit is to process the video signal in a manner wherein it takes a composite video signal, and converts it into a digital "bit map" signal for further processing. The image processing circuit 122 preferably comprises an Insync Technologies Model No. ITI74450 frame grabber, and includes a camera cable to cable the processing circuit to the camera 80. The frame grabber electronic video processing circuit can be installed into a standard ISA bus slot within the central processing unit 124.

The central processing unit 124 comprises the heart of the device 91. The central processing unit 124 is coupled not only to the imaging processing circuit 122, and through it to the camera 80, but is also coupled to a display unit such as a color SVGA monitor 128. The monitor 128 is coupled to the CPU 124 using the standard 15-pin SVGA video port on the CPU. The CPU 124 is further coupled to the Random Access Memory (RAM) 126. RAM 126 is preferably installed within the CPU 124. The CPU 124 is also coupled to a data input device, such as a keyboard 130 or mouse (not shown). Finally, the CPU 124 is coupled to the stepper motor 106, so that the CPU 124 can control the movement of the stepper motor 106, and hence, the vertical movement of the camera 80 along the track 100. The central processing unit 124 preferably comprises an IBM compatible personal computer, although with appropriate software adjustments, other computers could be used. If an IBM compatible personal computer is used, the computer should preferably contain at least a 200 MHz Pentium MMX micro processor, two RS-232 serial ports, and a RAM 126 that is at least 32 megabytes in size, along with the standard keyboard.

B. An Overview of the Operation of the Device.

A human operator, by pressing the appropriate key on the keyboard 130 triggers the CPU 124 to send initialization commands to the stepper motor 106. Alternately, a mouse (not shown) could be attached to the CPU to send such a signal, or a photo eye could be used that automatically senses the presence of a stack in the camera's 80 field of view. In any event, the stepper motor 106 is actuated to cause the belt 112 to move, which, through its coupling with the mounting means 98, causes camera 80 to move in a direction that positions the camera 80 so that the bottom sheet 134 of the stack 70 is aligned with the bottom of the image taken by the camera 80. This first image is electronically converted from a visual frame signal into an electronic frame signal by the frame grabber (image processing circuit) 122. This electronic frame image which comprises an image of the edges of the sheets within the stack 70 is stored in the RAM 126 of the CPU 124.

The CPU 124 then sends a command to the stepper motor 106 to vertically move the belt assembly 112 a fixed distance, so that the camera 80 will move a similar fixed distance. The camera 80 should move a sufficient distance so that the visual image taken by the camera 80 will include sheets that were not contained within the first image. This second visual image frame is also converted by the image processing circuit 122 into an electronic frame and is also transmitted to the CPU 124 which stores this second image within the RAM 126, along with the first image taken previously.

Software contained within the CPU 124 analyzes the two stored images. The software includes comparison means for comparing the first stored image to the second stored image, to compensate for any overlap of the images, to ensure that any sheets that are contained in both the first and second images are counted only once. Once these "overlap" sheets are treated so that they are counted only once, the software then counts the number of resultant horizontal pixel bars. Each pixel bar represents a corrugated sheet. The total count is then displayed for the operator.

Within the software is an element called a spatial probe. A spatial probe comprises a list of pixels, their orthogonal off-sets from a single designated pixel, herein called the origin, and a desired state, turned-on, a one state, or turned-off, a zero state for each location. The application of a spatial probe tests every location in an image, determining if pixels exist in the exact proximity and state as defined by the spatial probe. The spatial probe in this case lists all pixels which uniquely describe the sinusoidal shape of the middle flute layer 89 of the corrugated sheets 70. By repeatedly overlaying the spatial probe on the entire image of the stack of sheets, the software looks for a match between the probe and the camera image. The existence of such a match detects the presence of a flute liner 89.

Since most manufacturers include a mix of B-flute, C-flute, E-flute, and double wall, a combination of flutes usually B-flue, C-flute, the following automatic discrimination function is used to determine the exact processing to follow. A spatial probe exists which best describes the approximate dimensions of B-flute. A tolerance equal to normal variances in flute manufacturing is allowed. As a result of applying a spatial probe a number is returned proportional to the number of times that spatial probe has been recognized to exist in that image. This means a B-flute spatial probe will not fit as well, return a lower number, in the image of C-flute stack.

During the processing of the first segment image, a spatial probe belonging to the B-flute is applied. If the image is that of B-flute, the value of the returned number will be the highest values. Similarly, applying the B-flute spatial probe to the image of C-flute will return a range of smaller numbers. Applying the same B-flute spatial probe to the image of double wall will return a range of numbers somewhere in between the previous two ranges. Applying the B-flute spatial probe to E-flute will return a range of numbers near zero as B-flute is much larger than E-flute, and not expected to fit in an image of E-flute.

Adding additional flute selections may mean applying an additional image probe for discrimination purposes.

In the case of a double walled corrugated sheet, the total sheet count in the memory of the CPU 124 is divided by two to determine the actual sheet count of the stack 70.

With the camera's 80 zoom lens 96 set to its minimum magnification, and the horizontal distance from the camera lens to the nominal edge 74 of the stack 70 set at 36 inches, the camera's field of view can encompass 44 sheets of B-flute single wall board, 33 sheets of C-flute single wall board, and 19 sheets of B/C-flute double wall board. With the camera's zoom lens set to its maximum magnification, the field of view results in 20 sheets of E-flute single wall board.

A region of interest is also selected. Turning now to FIG. 5, the region of interest (ROI) 140 is defined as a relatively narrow vertical field that extends vertically across a plurality of corrugated sheets. Preferably, the ROI 140 should extend along all of the corrugated sheets of the stack 70. Preferably also, the region of interest 140 is somewhat narrower than the entire surface 74, and corresponds generally to the area from which the visual image is captured by the image capturing camera 80.

DETAILED DESCRIPTION OF OPERATION

Figure 6A:
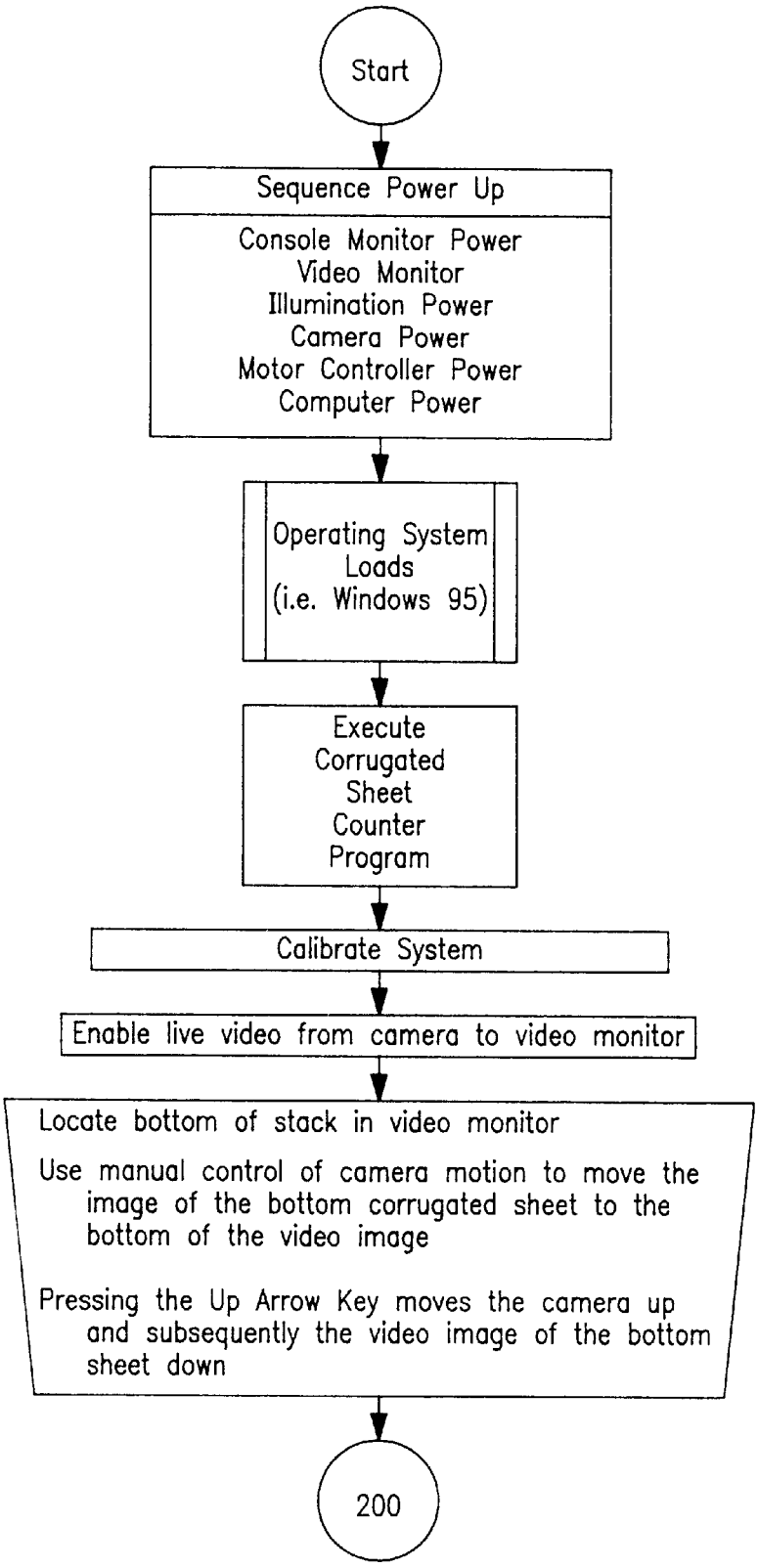
FIGS. 6A–6F are a schematic, flow chart representations of the process of the present invention.
Figure 6B:
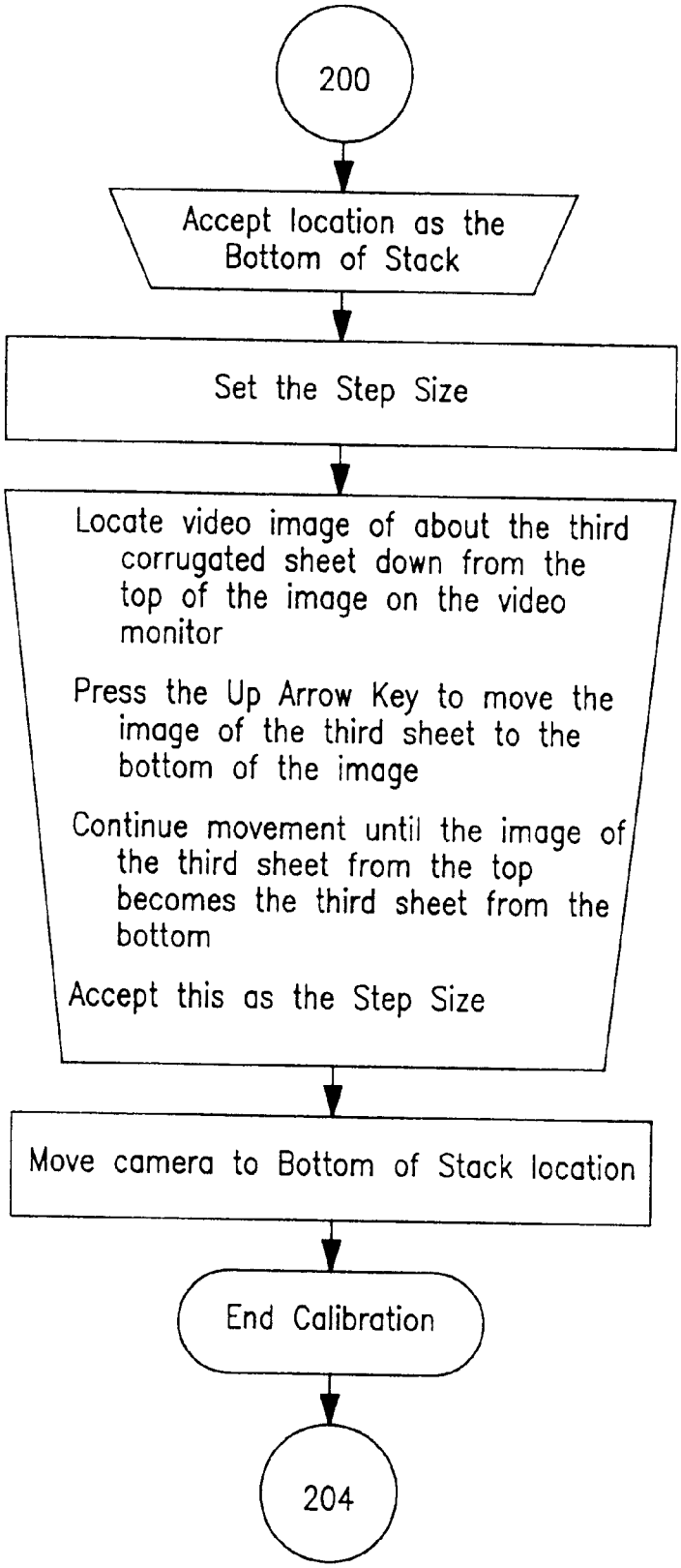
Figure 6C:
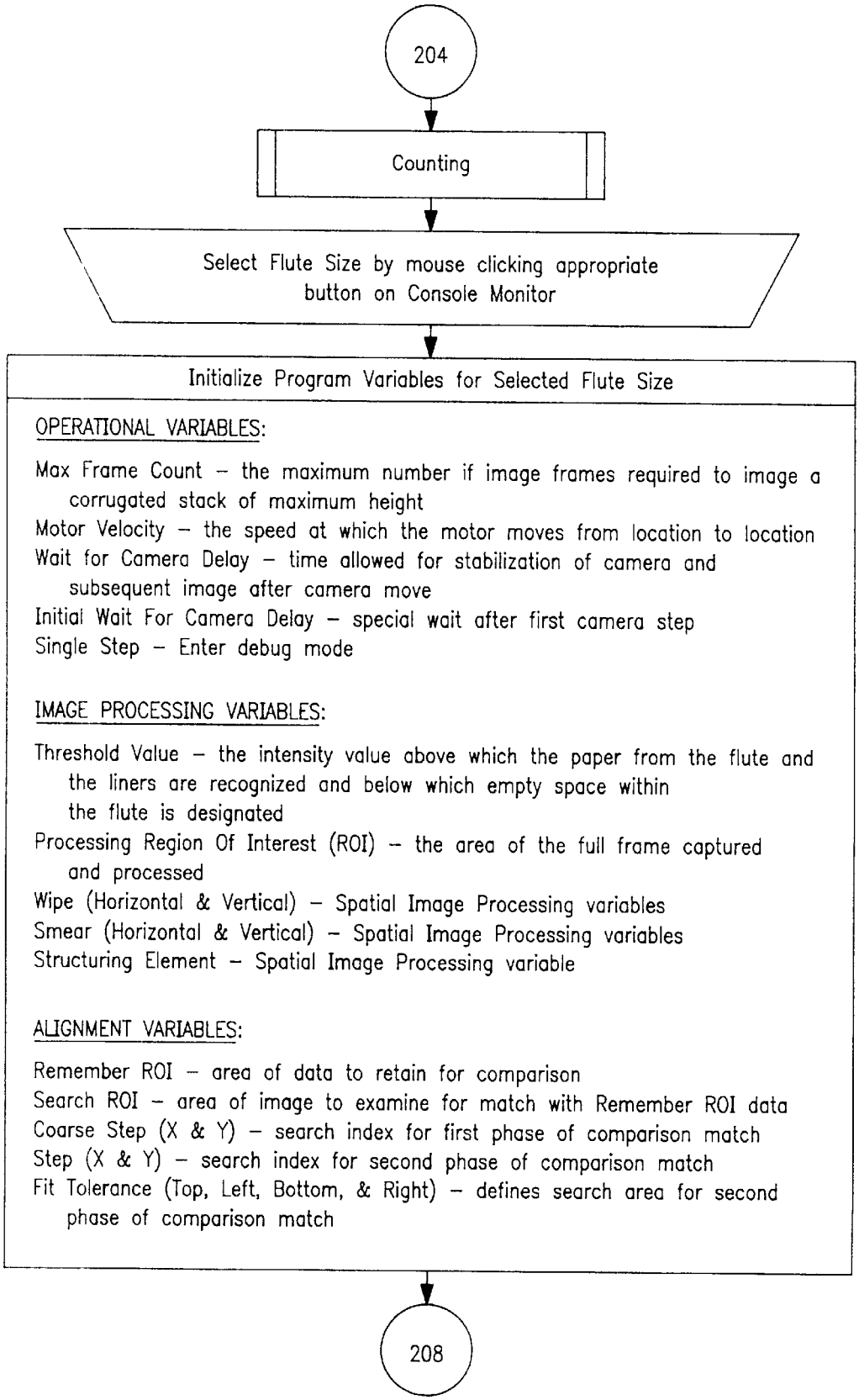
Figure 6D:
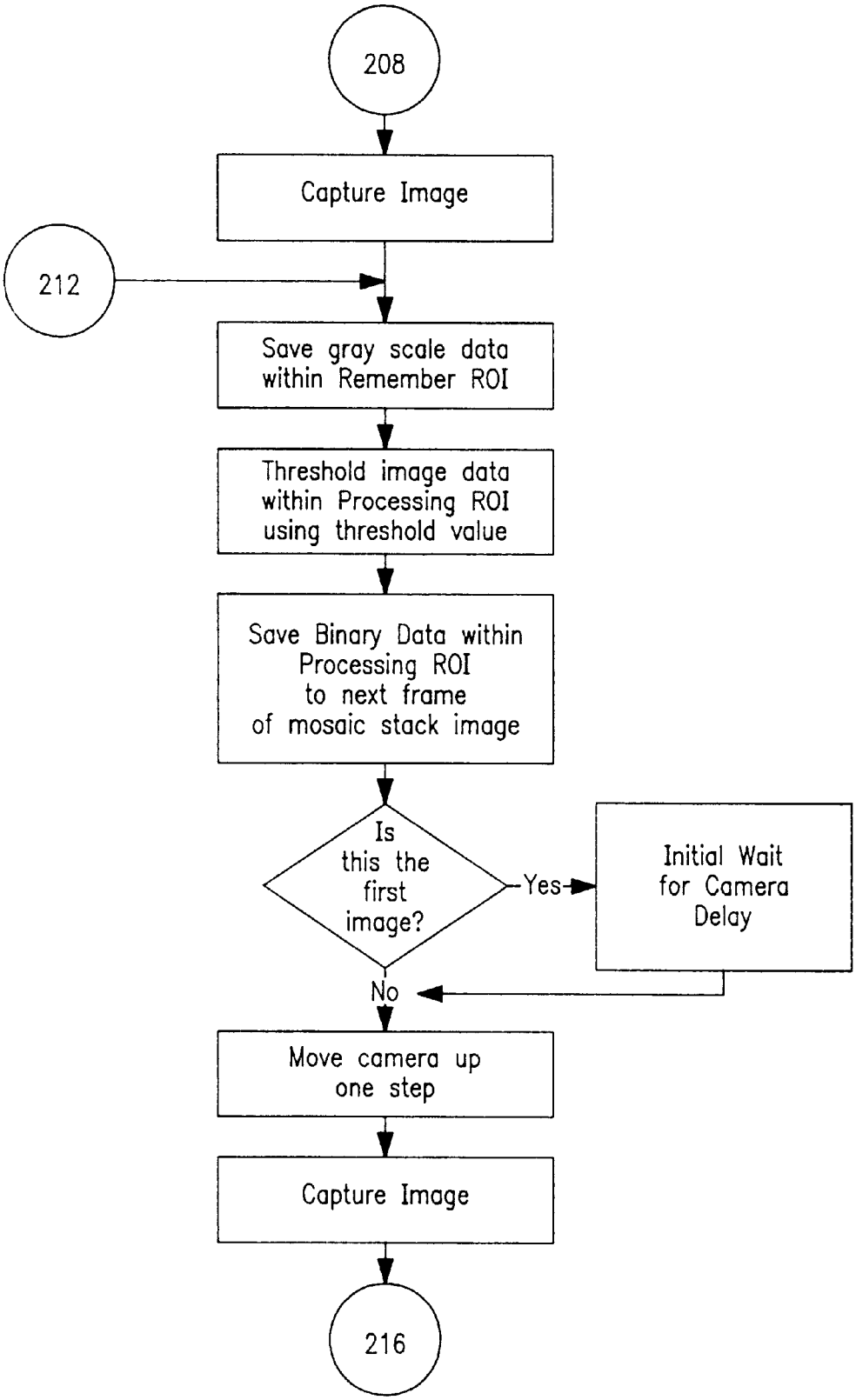
Figure 6E:
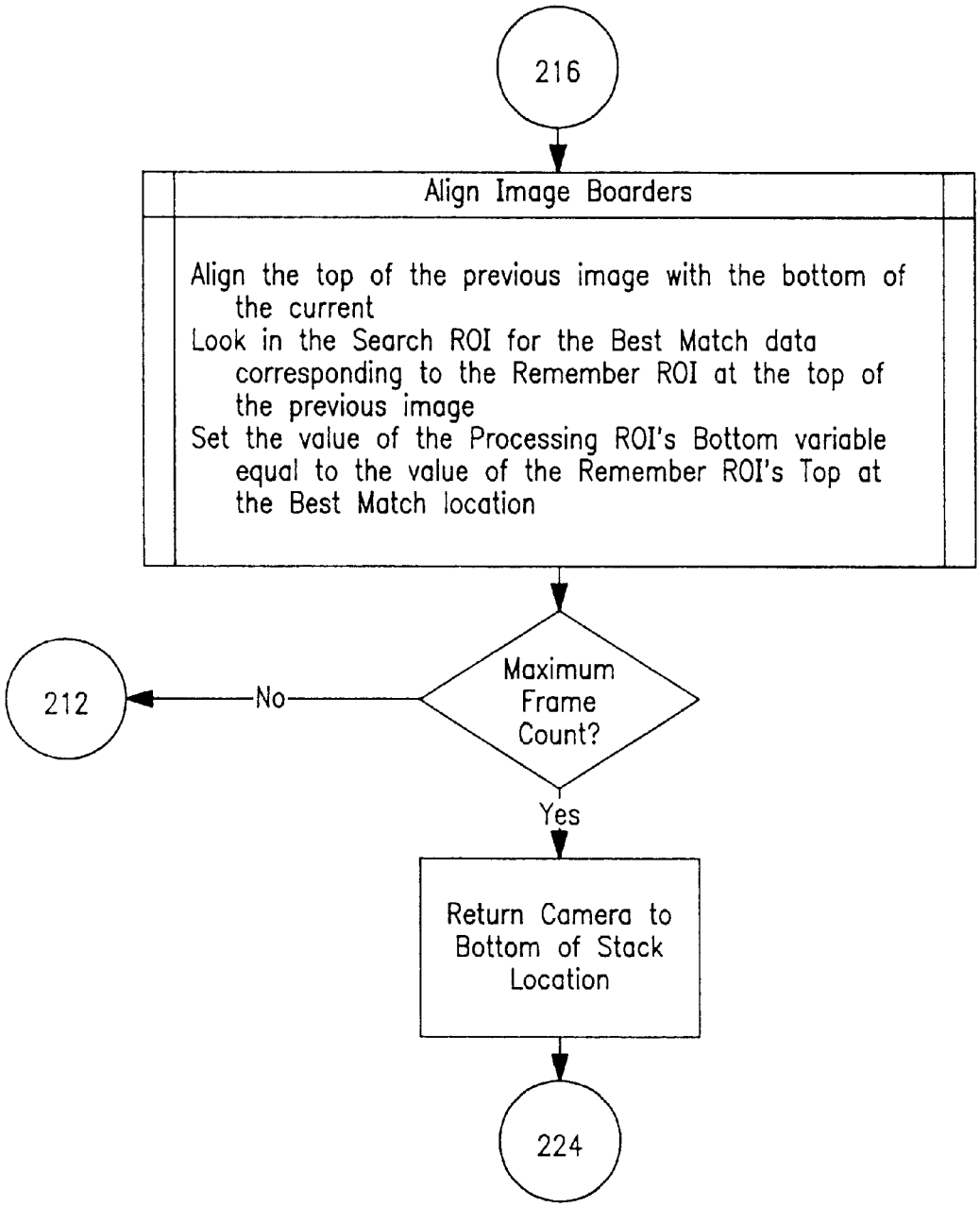

The operation of the invention will now be described in greater detail, with reference to FIGS. 6A–6F. Turning now to FIGS. 6A–6F, the process for counting corrugated sheets of the present invention will be described in more detail. As FIGS. 6A–6F represent a single flow chart, end points on a particular figure (e.g. end point 200 of FIG. 6A), are numbered so that they may be aligned properly with a start point (e.g. start point 200 of FIG. 6B) of an appropriate, other figure. In this regard, it will be noted that FIG. 6A includes end point 200; FIG. 6B includes a start point 200, and an end point 204; FIG. 6C includes a start point 204, and an end point 208; FIG. 6D includes a start point 208, an end point 216, and a loop-start point 212; FIG. 6E includes a start point of 216, an end point 224 and a loop end point 212; and FIG. 6F includes start point 224, and loop end point/start point 204. Additionally, FIG. 6F includes a process "end point" designated as "end" at the bottom of FIG. 6F.

The first step in a sequence power up, wherein the power is turned on for all of the monitor 128, camera 80, stepper motor 106, CPU 124, image processing circuit 122, display 128, and light source 90. During this power up, the operating system of the CPU 124 is loaded onto the Random Access Memory 126. An automatic batch file then executes the corrugated sheet counter program of the present invention. The corrugated sheet counter program of the present invention comprises custom-developed software developed by the applicants to perform the functions set forth in this application and the flow chart of FIGS. 6A–6F. The steps executed by the sheet counter program will be described in more detail below.

The first operation that must be undertaken is to calibrate the system. The system is calibrated by first enabling a live video visual image from the camera 80 to the video monitor. The operator then views the video image on the display 128, and locates the bottom of the stack 70 in the video monitor. In order to perform the calibration, the stepper motor 1106 should be instructed by the CPU 124 to raise the camera 80 from the power-off location at the bottom of the track 100, so that the bottom of the stack comes into the field of view of the the camera 80 lens 96. Using a manual control of the stepper motor 106, the camera 80 is moved along the track 100 to a point, wherein the image being taken by the camera 80 lens 96 shows the lower most corrugated sheet 134 being placed at the bottom of the video image shown on the display 128.

Once the lower most sheet 134 is placed at the lower most portion of the visual image captured by the camera 80, this particular first visual image, and in particular, the position of the camera 80 along the track 100 at which this first visual image is taken, is then accepted as the location of the bottom of the stack 70. Additionally, the particular corrugated sheets (including the bottom most corrugated sheet 134) that are captured within the visual image will be referred to herein as the "first segment" of articles. In order to capture all of the corrugated sheets of the stack 70, a plurality of visual images, representing a plurality of segments of sheets must be captured by the camera 80, and processed, and compared by the central processing unit 124 to arrive at the total number of sheets within the stack 70. If the stack is very short, it is possible that the camera could capture all of the sheet within a single frame vertical image. More likely however, it will be necessary for the camera 80 to capture all of the sheets of the stacks 70 by capturing a plurality of vertical images or "stack segments" in order to capture the "whole stack".

The next step that must be performed is to adjust the step size, which refers to the amount of vertical movement undertaken by the camera 80 in order to capture the second "segment" of corrugated sheets. The step size should be adjusted so that some overlap in corrugated sheets exists between the first segment and the second segment. However, the overlap should not be too great, because the use of a large overlap will require that a greater number of segments be taken in order to capture the entire stack.

As best shown in FIG. 4, three of the segments, 140, 142, and 144 are shown as having some degree of overlap, and representing the first (lower) three segments of the stack 70, which in total, probably has approximately five segments. It will be noted that about a six sheet overlap exists between each of the segments 140, 142, 144. This overlap is necessary in order to ensure that a proper count is made, and that no sheets are lost by falling between the segments. As will be described in more detail below, comparison means within the software of the CPU 124 compares the second step 142 to the first step 140, to uncover the existence of the three corrugated sheets that are contained in both the first segment 140 and the second segment 142. These overlapping corrugated sheets are then treated properly to ensure that they are not doublecounted.

Because of the need to use a plurality of segments in order to capture the entire stack 70, an important step in the calibration of the device is the proper setting of the step size. The step size relates to the amount of the vertical movement of the camera 80 along the track 100, so that the camera 80 can move from a position where it can capture the first segment 140 (as described below), to a point where it can capture the second segment 142.

The first step in setting the step size is to locate the video image of approximately the third corrugated sheet down from the top of the image on the video monitor of the first video segment 140. The up arrow key on the keyboard 130 which controls the stepper motor 106, and hence the vertical movement of the camera 80 is then pressed in order to move the camera 80 upward to a point where the image of this third sheet is moved to the bottom of the image of the video monitor. The vertical position of the camera 80 is adjusted until a point is reached where the corrugated sheet (sheet 145 of FIG. 4), which formerly was the third-from-the-top corrugated sheet of the first segment 140, becomes the third-from-the-bottom corrugated sheet of second segment 142. At this point, this incremental movement of camera 80 is then accepted as the appropriate step size. The distance moved by camera 80 during this particular step can then be repeated from this point upwardly to properly position the camera 80 for capturing a visual image of the third segment 144, which should have the same vertical length as the second segment 142. After step calibration is performed, the camera 80 is moved to the bottom of the stack 70 by causing the stepper motor 106 to turn the belt assembly to move the camera 80 toward the bottom of the track 100. After this is completed, calibration of the unit is then finished.

The calibration discussed above is usually done very infrequently. When the device is first put into operation, it must be calibrated. After the device is in operation, there is generally no need to calibrate it again.

Once so calibrated, the device can be used for counting stacks. However, before the counting begins, there exists a group of program variables that should be addressed and appropriate values inserted for the variables. These variables represent differences between the various flute sizes, and thereby require the insertion of different values for the various flute sizes. As such, the first time that the device is used, the program values should be set for all of the particular variables of the different types of flutes (e.g. A-flute, C-flute, B-flute) to be counted by the device. Three different catagories of variables exist for each type of flute size. These variables include: (1) operational variables; (2) image processing variables; and (3) alignment variables.

The operational variables include (1) max frame count; (2) motor velocity; (3) camera delay wait time; (4) initial wait for camera delay; and (5) single step debug mode. The max frame count variable relates to the setting for the maximum number of visual image frames that the camera 80 is required to capture to acquire a full image of an entire corrugated stack of the maximum height that the device is likely to encounter during operation. Motor velocity relates to the speed at which the camera 80 moves from location to location, during its step-wise movement up the track 100. The wait for camera 80 delay relates the time that is allowed for stabilization of the camera 80 and the image being taken by the camera 80 after a movement of the camera 80 to a new location. Because it is very helpful to have a stable camera in order to should be allowed to stabilize itself after being moved. As such, a delay should exist between the time the camera 80 stops its movement after making a step-wise move, and the time at which the visual image frame being taken by the camera 80 is used by the CPU 124. Typically, this wait is in the order of a couple of tenths of a second, and should be long enough to enable the vibration from movement to be dampened out.

The initial wait for camera delay relates to a special wait or delay period that is induced after the first camera step. This initial, special wait is made to accommodate additional processing necessary for the device to determine whether the stack of sheets contains double-wall or single-wall sheets.

Single step enters a debug mode in which the operator has control over the raising of the camera 80 along the track 100. Movement of the camera 80 only occurs after manual intervention by an operator.

The image processing variables include: (1) a threshold value variable; (2) a processing region of interest (ROI) variable; (3) a wipe variable; (4) a smear variable; and (5) a structuring element variable. The threshold value variable relates to a variable that sets a threshold value relating to the intensity of the signal. The threshold value comprises an intensity value for the signal from the electronic frame, above which the device recognizes the signal as representing paper from the flute 89 layers, and top 87 and bottom 88 liners. Below this threshold intensity value the device recognizes the signal as being representative of empty space, such as empty space 90 within the region adjacent to the flute 89. Setting the threshold value, and recognizing signal values of greater or lower intensity than the threshold value requires a signal discriminator that is contained within the processing circuit 122 where CPU 124 exists.

A processing/region of interest (ROI) variable relates to the selection of the particular frame portion to be processed from the full visual image frame that is captured by the camera 80. As shown in FIG. 5, the ROI is narrower than the entire surface 74 that is placed in front of the lens 96 of camera 80 (at FIG. 4). Additionally, the ROI 140 is preferably narrower than the full frame captured by the camera 80. Because of the method that the device 91 uses to count the corrugated sheets, there is no need to process information that relates to the entire width of the surface 74 of stack 70, or even to process information that relates to the entire width of the visual image frame captured by the camera 80. By reducing the ROI 140 to an area that is narrower than the full width of the camera frame, less data needs to be processed, which increases the speed at which the device 91 can operate. Further, many camera lenses 96 are less capable of defining sharp images at the periphery of their visual image frames than they are at the center of their visual image frames. As such, by confining the region of interest to the area in the middle of the frame, the user is more likely to process only better defined data.

The wipe variable is adjusted both in the horizontal and vertical dimension, and relates to a spatial image processing variable. The smear variable is also processed in the horizontal and vertical dimension, and relates to a spatial image processing variable, as does the structuring element variable. Wipe and smear are operations performed on the image data returned after applying a spatial image probe. In a new, separate image, one pixel is turned-on at each location where pixels in the corrugated image exactly match the on-off configuration of the spatial probe. A pixel returned signifies a match. Wipe and smear turn the collection of matches associated with a single corrugated sheet into a solid rectangle of pixels in a turned-on or logical one state. The rectangles are easily counted to determine the number of sheets in a stack.

If a pixel is turned-on, the smear operator has the effect of turning on pixels next to itself for a magnitude of distance determined by the smear variable. The wipe operator has the opposite effect of turning off pixels next to itself for a magnitude of distance determined by the wipe variable. The direction of the wipe or smear is indicated by the horizontal or vertical prefix.

The alignment variables include: (1) Remember ROI; (2) Search ROI; (3) coarse step (x&y); (4) step (x&y); and (5) fit tolerance (top, left, bottom & right).

The "Remember ROI" variable relates to the area of data to retain for comparison. As discussed above, the region of interest is generally smaller than the full frame width of the image captured by the camera. The data that is remembered for comparison to a second segment of articles (for detecting overlap of sheets) may even be narrower (and hence contain less data) than the ROI that is analyzed in the first place in order to count the number of sheets in a particular segment.

The "Search ROI" data variable relates to a variable that deals with the area of the image to be examined for a match with the Remember ROI data. In performing the process of the present invention, an electronic frame signal that is created from the visual image frame taken by the camera 80 is processed by the image processing circuit 122 and the CPU 124. During the time when data from, for example, the first step 140 (FIG. 4) is being analyzed, the data that is being analyzed is taken from the region of interest, and is stored within the RAM 126 of the CPU 124. A portion of this ROI data is then remembered. When the camera 80 is moved to a position wherein it can capture data from the second segment of articles 142, the data that is taken from the electronic frame signal (that itself is taken from the visual image taken by camera 80) is processed by the CPU and also stored in the RAM 126. A portion of the ROI information from the second step 142 that is stored in the RAM 126 is then compared against the stored "Remember ROI" data that was taken from the first step 140. This comparison of the electronic image data from the first segment 140 and the second segment 142 permits the device to determine exactly where the overlap exists between the sheets of the first segment 140 and the sheets of the second segment 142. Once this overlap is located, the sheet count is adjusted to ensure that these "overlap" sheets are counted only once. The Search ROI data relates to the area of the image that is examined for comparison to the Remember ROI data taken from a prior segment.

The coarse step variable relates to a search index for a first phase comparison match. In the coarse step, data from the Remember ROI is compared to data from the search ROI in indexed increments. For an index of two, only every other location is compared. The purpose of the coarse step is to rapidly search a large area, to uncover areas wherein a high potential exists for a match.

The step (X&Y) relates to a more "fine" search index for a second phase of comparison match. In this second phase, the high potential match areas found in the coarse step are compared on a pixel by pixel basis to find the closest match.

The "fit tolerance" variable defines the search area for the second phase of the comparison match. The fit tolerance defines the search area with respect to the top, left, bottom, and right of the region of interest for this particular step. In other words, the fit tolerance variable tells the processing unit, during the fine step, that the area being searched represents one wherein a good match potential exists.

After the variables are adjusted appropriately, the user can then begin counting sheets of corrugated articles 74 in a stack 70. This is done by using the camera 80 to capture a visual image of a portion of a surface 74 of the stack 70. Although the first image can be captured from any portion of the stack, the applicants have found that it is best to start at the bottom of the stack so that the first image captured is of the first segment 140. Once the visual image frame is captured by camera 80, the visual image frame is converted into an electronic image frame by a processing means which may be found in the camera 80, or may comprise the image processing circuit 122. The image processing circuit 122 then transfers the electronic image frame data to the CPU 124 for further processing. The CPU 124 saves the gray scale data within the Remember ROI field that is defined within the RAM 126. The Processing ROI data is processed with respect to its gray scale features. Images having an intensity greater than the threshold image value are then differentiated from signals having an intensity lower than the threshold value. This discrimination is performed by a discriminator means within the processing software of the CPU 124. Based on intensity, the discriminator discriminates between the data representative of flutes 89, top liners 87 and bottom liners 88; and the spaces 90 between the flutes 89, which is not representative of any material.

The binary data that is obtained from the threshold image data (discussed above) has been saved within the processing ROI so that it can be compared by the comparing means within the processor to the next frame of the mosaic stack image, that is derived from the visual image taken by the camera 80 of the second segment of articles 142 (FIG. 4). If the image that is being processed is the first image taken by the camera 80, the processing means induces an initial wait for camera delay for the reasons set forth above.

If the image being taken is not the first image, the camera 80 is then moved up on the track 100 one step, such as from the position where it can capture a visual image of the first segment 140, to a position wherein it can capture a second segment image 142. As discussed above, the incremental steps that the camera 80 takes up the track 100 should all be equal, to a point wherein the camera 80 has taken the last step. The last step is defined as that step necessary for the camera 80 to take in order to capture the top most sheet of the stack 70.

Once the camera 80 is moved up the track 100, a second visual image is captured that is representative of the second segment of articles 142. Once the second visual image frame is captured by the camera 80, it is converted into an electronic image frame by either the camera's circuitry 80, or the image processing circuitry 122. The second electronic image frame is then compared to the first electronic image frame to ensure that any sheets that appear in both of the first and second images are identified, so that they will not be double-counted. This process is known as "aligning the borders". The borders are aligned by first aligning the top of the first image (from segment 140) with the bottom of the then current image, (here the image taken from the second segment of articles 142). The Search ROI is then searched for the best match data that corresponds to the Remember ROI at the top of the previous image. As will be remembered, the Search ROI data relates to data from the second segment 142, and the Remember ROI data contains data from the first image 140. The best matched data is looked for, to determine the existence of any overlap between the first 140 and second 142 segments. The value of the Processing ROI's bottom variable is then set equal to the value of the Remember ROI's top, after the best match location. This step properly aligns the bottom of the second segment 142 with the top of the lower segment 140 to eliminate any overlap.

The next step in the process is to determine whether a maximum frame count has been achieved yet. The maximum frame count relates to the number of frames necessary for the camera 80 to capture visual images of the surface 74 of the stack 70 as it travels up the track 100, in order to capture all segments of the stack 70. In the drawing shown in FIG. 4, the three segments 140, 142, 144, when combined, comprise approximately 60% of the vertical height of the stack 70. As such, it is likely that the maximum frame count necessary to capture all of the corrugated sheets of stacks 70 would probably be five or six. In operation, the maximum frame count should normally be set to the number of frames necessary to capture the tallest stack that is likely to be encountered during operation of the device 91. It should also be noted that it is disadvantageous to set the maximum frame count too high, as this will likely increase the time required by the device to count a stack of sheets, as the device would be forced to count additional "frames" that are more likely than not devoid of any corrugated sheets.

After the maximum frame count has been made, and the camera 80 has traveled to a point wherein all of the corrugated sheets within the stack 70 are counted, the camera 80 is then returned to the relatively low position on the track 100, wherein it is positioned to capture the bottom segment 140 of the next stack 70 to be counted.

Conversely, if a maximum frame count is not yet met, the process returns to point 212 (on FIG. 6D), and the data is processed for the next step.

Figure 6F:
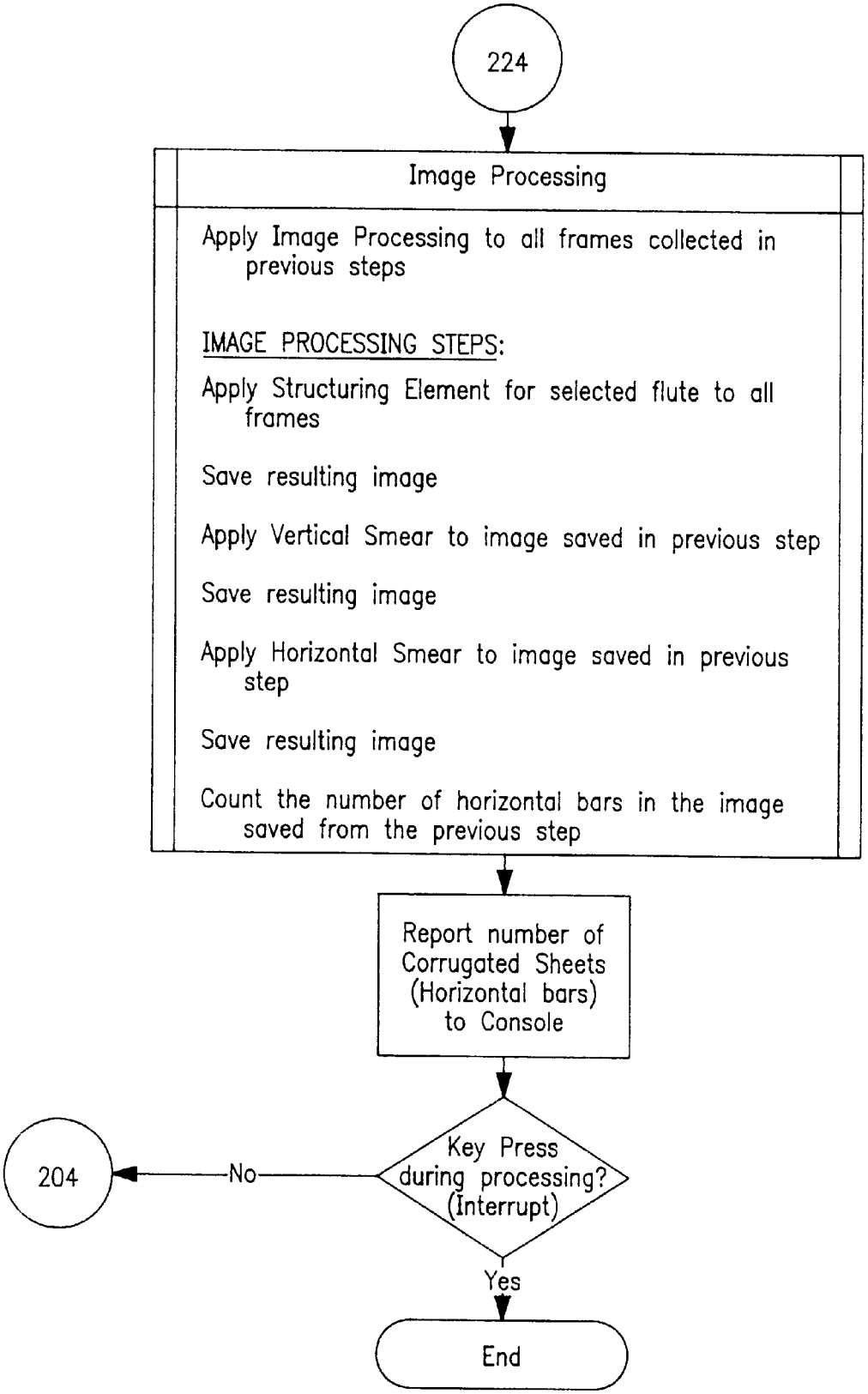

The next step within the process is shown at FIG. 6F, wherein the CPU 124, in combination with the. image processing circuit 122, and RAM 126 process the electronic image data frames to make an accurate count of the number of corrugated sheets in the stack 70. As inferred above, all of the images of all of the segments taken previously have all been processed, as also discussed above. To obtain the grand total count, the results from the image processing steps for all of the frames are correlated together, and added together to derive a final number representative of the number of sheets within the entire stack 70. The image processing steps include applying the structuring variable for the selective flute to all of the frames. The resulting image is then saved. A vertical smear is then applied to the image saved in the previous step, and the resulting image is saved. The horizontal smear is then applied to the image stage in the previous step, and the resulting image is saved. The number of horizontal bars in the image saved from the previous step is then counted. The number of horizontal bars that are counted relate to the number of particular flute liners 89 which are present.

If the process above has been interrupted, the device should cycle back to start point 204 of FIG. 6 C, and the counting should be started over again, or at least be started over at a point prior to the interruption. On the other hand, if the process has been completed without interruption, the process can then be ended.

As the program variables for selected flute size should remain constant from stack to stack, there is no need to initialize program variables when another stack is counted.

Having described the invention in detail with respect to certain preferred embodiments, it will be appreciated that modifications and variations exist within the scope and spirit of the claims appended hereto.

What is claimed is:

1. An apparatus for counting the number of corrugated articles in a stack of corrugated articles, each corrugated article having an edge including at least two layers forming at least one space therebetween, the apparatus comprising:

(1) a light source for illuminating an edge of an at least one corrugated article in the stack of corrugated articles;

(2) a camera for capturing a visual image of the edge of the at least one corrugated article in the stack;

(3) a signal converter for converting the visual image into an electrical signal; and (4) a processor for processing the electrical signal to count the at least one article in the stack by differentiating between the at least two layers of the at least one article and the at least one space between the at least two layers of the at least one article.

2. The apparatus of claim 1, wherein the camera includes a plurality of pixels arranged in a horizontal linear orientation relative to each other to form a horizontal line detector array; and wherein the apparatus further comprises:

a mounting means for mounting the camera;

a moving means for moving the camera from a first position to a second position thereby permitting the horizontal line detector array to capture a second visual image of the edges of more than one article in the stack of conrrugated articles.

3. The apparatus of claim 2, wherein said moving means moves said camera in incremental steps.

4. The apparatus of claim 2, wherein said moving means moves said camera in a continuous motion.

5. The apparatus of claim 1, wherein the camera includes a plurality of pixels arranged in a vertical linear orientation relative to each other to form a vertical line detector array; and wherein the apparatus further comprises:

a mounting means for mounting the camera;

a moving means for moving the camera from a first position to a second position thereby permitting the vertical line detector array to capture a second visual image of the edges of more than one article in the stack of corrugated articles.

6. The apparatus of claim 5, wherein said moving means moves said camera in incremental steps.

7. The apparatus of claim 5, wherein said moving means moves said camera in a continuous motion.

8. An apparatus for counting the number of corrugated articles in a stack of corrugated articles, each corrugated article having an edge including at least two layers forming at least one space therebetween, the apparatus comprising:

(1) a light source for illuminating the edges of the corrugated articles in the stack of corrugated articles;

(2) a camera for capturing a visual image of all the edges of the corrugated articles in the stack;

(3) a signal converter for converting the visual image into an electrical signal; and (4) a processor for processing the electrical signal to count the articles in the stack by differentiating between the at least two layers of the articles and the at least one space between the at least two layers of the articles.

9. A method of counting the number of corrugated articles in a stack of corrugated articles, each corugated article having an edge including at least two layers forming at least one space therebetween, the method comprising the steps of:

(1) illuminating an edge of an at least one corrugated article in the stack of corrugated articles;

(2) capturing a visual image of the edge of the at least one of the corrugated articles in the stack;

(3) converting the visual image into an electrical signal; and (4) processing the electrical signal to count the articles in the stack by differentiating between the at least two layers of the articles and the at least one space between the at least two layers of the articles.

* * * * *